US007451501B2

(12) United States Patent
Cheng

(10) Patent No.: US 7,451,501 B2
(45) Date of Patent: Nov. 18, 2008

(54) BATHING CHAIR WITH FIXING DEVICE

(75) Inventor: Yu-Wen Cheng, Taichung (TW)

(73) Assignee: Eagle Health Supplies Inc., Orange, CA (US)

( * ) Notice: Subject to any disclaimer, the term of this patent is extended or adjusted under 35 U.S.C. 154(b) by 248 days.

(21) Appl. No.: 11/585,450

(22) Filed: Oct. 23, 2006

(65) Prior Publication Data

US 2008/0092288 A1 Apr. 24, 2008

(51) Int. Cl.
*A47K 3/022* (2006.01)

(52) U.S. Cl. ..... 4/578.1; 4/560.1

(58) Field of Classification Search ..... 4/560.1, 4/571.1, 587.1, 579
See application file for complete search history.

(56) References Cited

U.S. PATENT DOCUMENTS 2,648,849 A * 8/1953 Webb et al. ..... 4/560.1
5,903,935 A * 5/1999 Huelke ..... 4/560.1
5,940,905 A 8/1999 Cheng
6,182,304 B1 * 2/2001 Freeberg ..... 4/560.1
6,334,225 B1 * 1/2002 Brinkmann ..... 4/560.1

* cited by examiner

*Primary Examiner*—Charles E Phillips
(74) *Attorney, Agent, or Firm*—Pro-Techtor Int'l Services

(57) ABSTRACT

A bathing chair with a fixing device comprises a front frame, a rear frame, a bearing assembly with several gliding blocks, with an opening cut into at least one of the gliding blocks, a seat, a handle, and a fixing device. The fixing device is mounted at a gliding block and further comprises two lugs, each having a hole and aligned on two sides of the gliding block, a blocking piece, having an excentric hole, an axis, passing through the holes of the two lugs and the excentric hole of the blocking piece, and an arm, attached to a periphery of the blocking piece. Manual turning of the blocking piece causes the blocking piece to reach through the opening, blocking the seat from moving.

5 Claims, 6 Drawing Sheets

BATHING CHAIR WITH FIXING DEVICE

FIELD OF THE INVENTION

The present invention relates to a bathing chair with a fixing device, particularly to a bathing chair with a fixing device which allows to fix a movable seat in any desired position.

BACKGROUND OF THE INVENTION

As shown in FIGS. 5 and 6, a bathing chair for assisting elderly and handicapped persons to enter and leave a bathtub has been disclosed in U.S. Pat. No. 5,940,905. The bathing chair taught therein comprises a front frame 21; a rear frame 22; a bearing assembly 3; a seat 4; a handle 5; and fixing devices 6, 6A. The front and rear frame rods 21, 22 are shaped like the inverted letter U, reaching across a bathtub 1 and have horizontal rods 211, 221 which pass over an edge 11 of the bathtub 1 at a distance. A right connecting rod 23A and a left connecting rod 23B connect the front and rear frame rods 21, 22. The seat is a plate of roughly rectangular shape and is mounted on the horizontal rods 211, 221, being movable along the horizontal rods 211, 221. The bearing assembly 3 comprises several gliding blocks which are connected with the seat 4 on a lower side thereof, keeping a distance thereto, and glide along the horizontal rods 211, 221. A backrest 41 is connected to the seat 4 by two L-shaped link rods 42A, 42B. The link rods 42A, 42B have horizontal extensions 421A, 421B, which are fastened to the gliding blocks of the bearing assembly 3. Thereby, the seat 4 is enabled to glide along the horizontal rods 211, 221. The handle 5 is a rod which is shaped like the inverted letter U and is fastened to the front and rear frame rods 21, 22 at left ends thereof, reaching higher than the seat 4 for providing a hold when the seat 4 is moved along the horizontal rods 211, 221. The fixing devices 6, 6A are made of plastics or another suitable soft material and are shaped like strips. The fixing devices 6, 6A have fixed ends 61, 61A and holding ends 66, 66A. The fixed ends 61, 61A are fastened to the link rods 42A, 42B of the seat 4, respectively. The holding ends 66, 66A are held on the right and left connecting rods 23A, as needed. At the holding ends 66, 66A, the fixing devices 6, 6A have endpieces 68, 68A from lower sides of which holding elements 67, 67A extend away, respectively. Fastening elements 63, 63A are attached to endpieces 62, 62A at the fixed ends 61, 61A and are in turn fastened to the link rods 42A, 42B to prevent shifting of the fixing devices 6, 6A. Before sitting down on the seat 4, a user pulls up the holding end 66, so that the holding element 67 is held on the right connecting rod 23A. For bathing, the user releases the holding element 67, which subsequently becomes detached from the right connecting rod 23A. The seat 4 is shifted leftward until a leftmost position over the bathtub 1, with the holding element 67A being held on the left connecting rod 23B.

A conventional bathing chair assists elderly and handicapped people to enter and leave a bathtub safely and conveniently. However, manual fixing of the position of the seat 4 is awkward, and there is a risk of inadvertent releasing of the seat 4. Furthermore, the seat 4 is fixable only in two positions.

SUMMARY OF THE INVENTION

It is an object of the present invention to provide a bathing chair with a fixing device which prevents inadvertent shifting of the seat during bathing.

It is another object of the invention to provide a bathing chair with a fixing device which prevents inadvertent shifting of the seat while a user is seated.

It is a further object of the invention to provide a bathing chair with a fixing device which allows to fix the seat conveniently.

It is a further object of the invention to provide a bathing chair with a fixing device which allows to fix the seat in any position.

Other aspects and advantages of the present invention will become apparent from the following detailed description, taken in conjunction with the accompanying drawings, illustrating by way of example the principles of the present invention.

DESCRIPTION OF THE PREFERRED EMBODIMENTS

Figure 5:
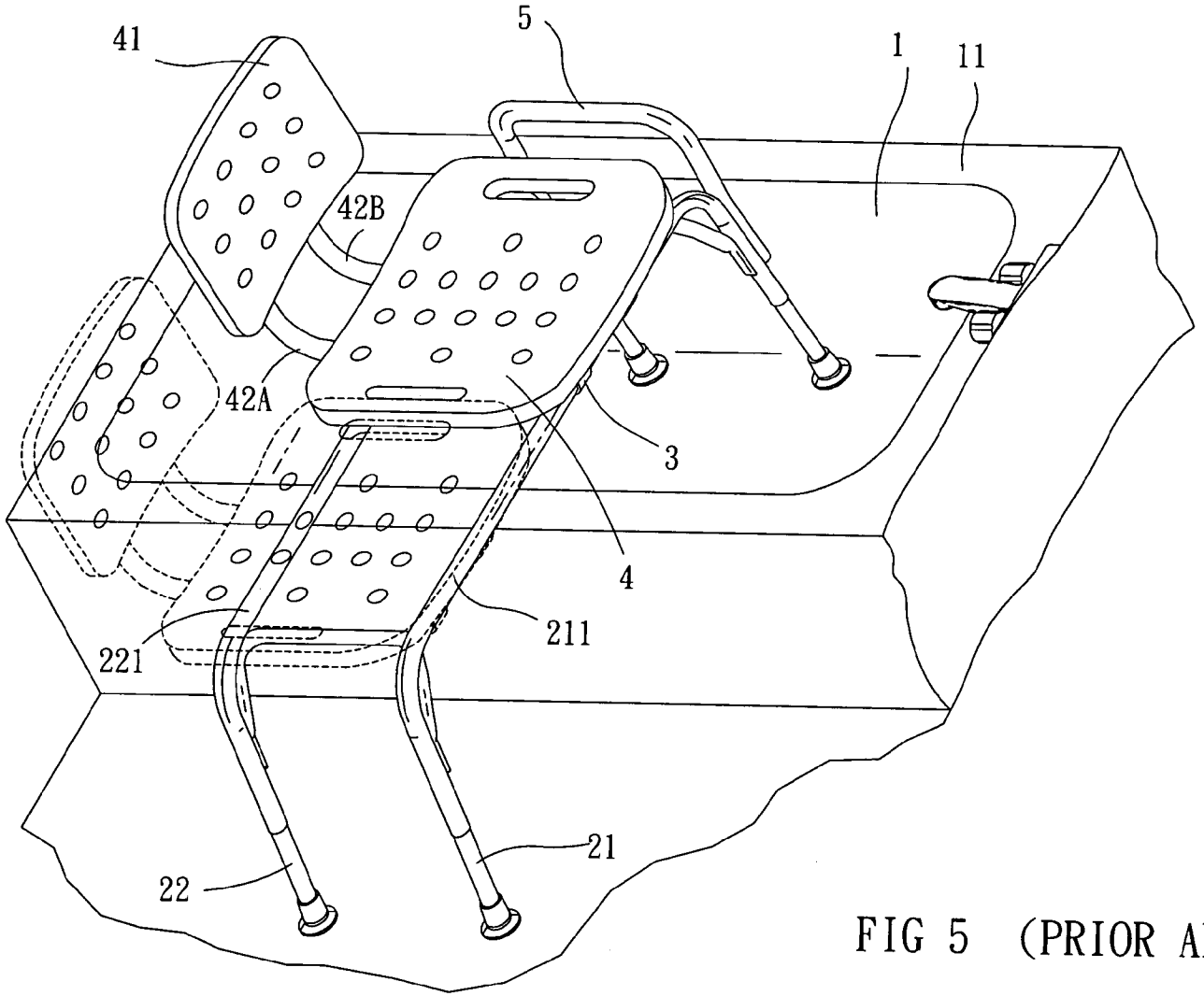
FIG 5 (PRIOR ART)
FIG. 5 (prior art) is a perspective view of a conventional bathing chair.
Figure 6:
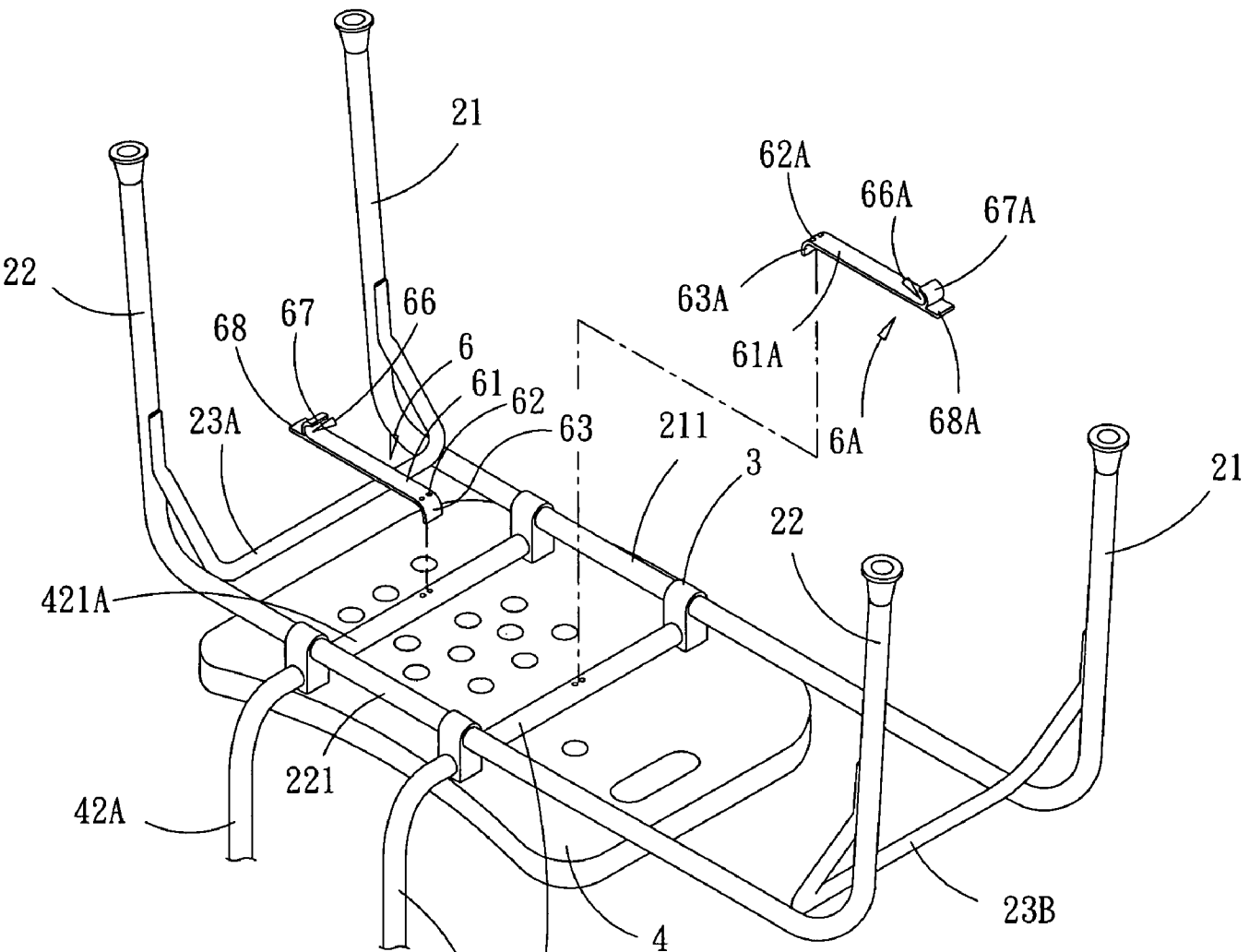
FIG 6 (PRIOR ART)
FIG. 6 (prior art) is an exploded perspective view of a conventional bathing chair.

As shown in FIGS. 1-3C, the bathing chair with a fixing device of the present invention has a structure which is about the same as the conventional bathing chair shown in FIGS. 5 and 6, with structural parts being denoted by the same numbers. The bathing chair with a fixing device of the present invention further comprises an opening on an outer side of at least one gliding block 3A of the gliding assembly 3 and a fixing device 7. The fixing device 7 prevents shifting of the seat 4 and allows to fix the seat 4 in any desired position. In the following, a detailed description is given.

The fixing device 7 comprises: two lugs 70, each having a hole 72 and aligned on two sides of the gliding block 3A; a blocking piece 71, made of elastic material, having a circular cross-section and an excentric hole 73, and placed between the two lugs 70; a sleeve 76, made of hard material and covering an inner wall of said excentric hole 73; an axis 75, passing through the holes 72 of the two lugs and the excentric hole 73 of the blocking piece 71; and an arm 77, attached to a periphery of the blocking piece 71 for manually turning the blocking piece 71.

Figure 1:
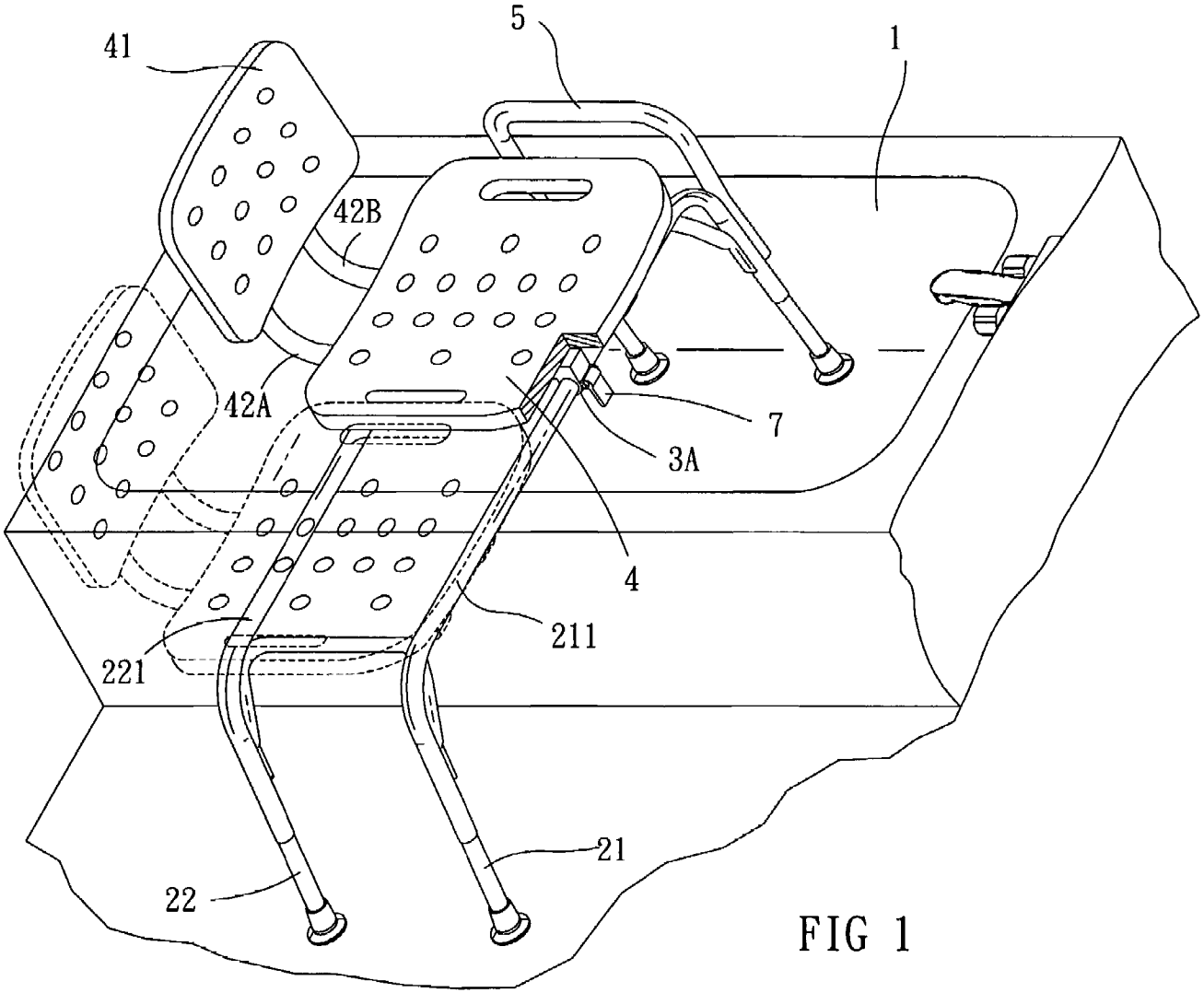
FIG. 1 is a perspective view of the bathing chair of the present invention.
Figure 2:
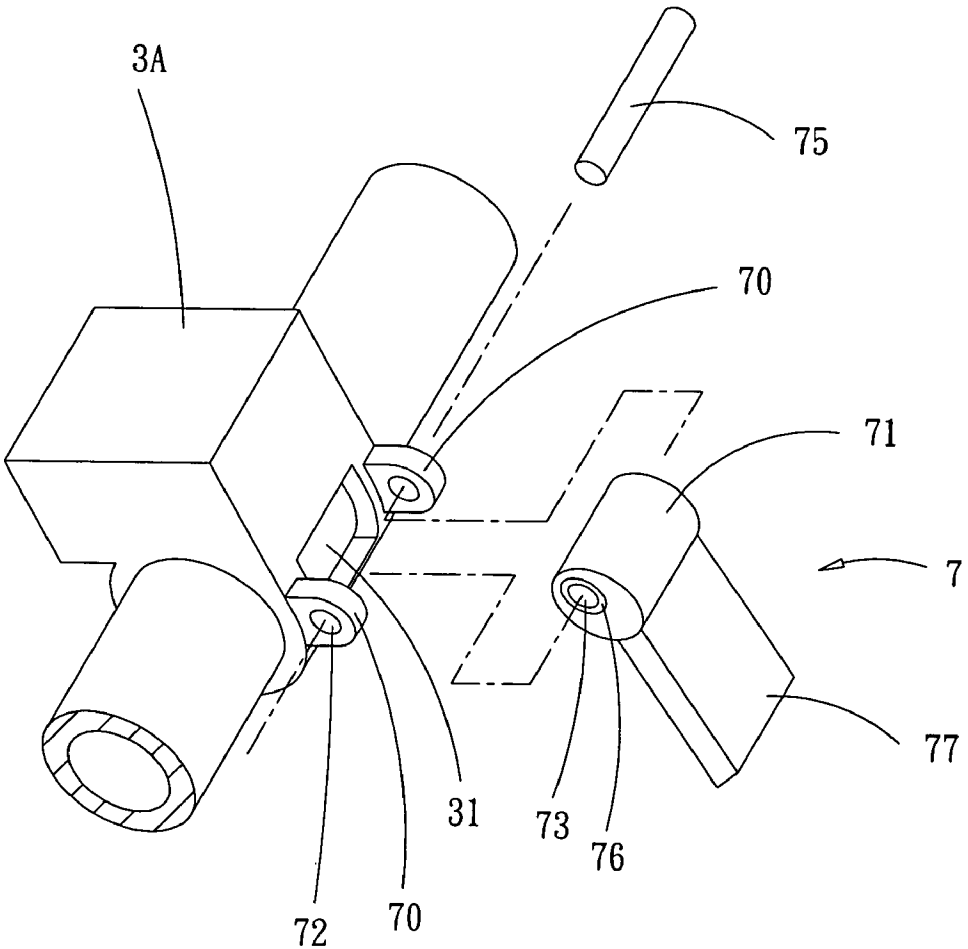
FIG. 2 is a perspective view of the fixing device mounted on a gliding block of the present invention.
Figure 3A:
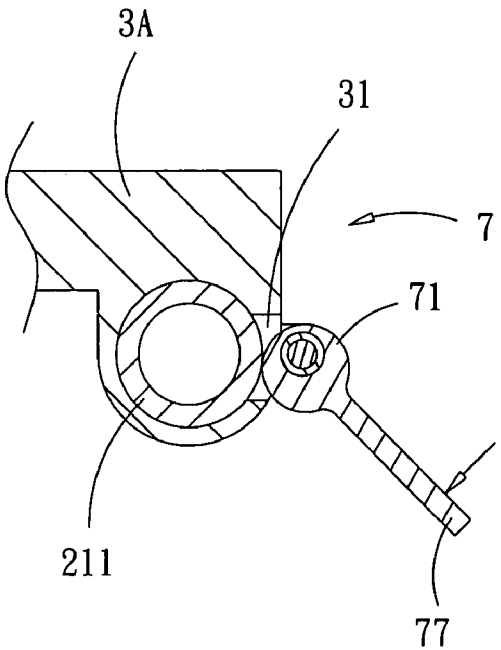
FIGS. 3A-3C are schematic illustrations of the movement of the fixing device of the present invention.
Figure 3B:
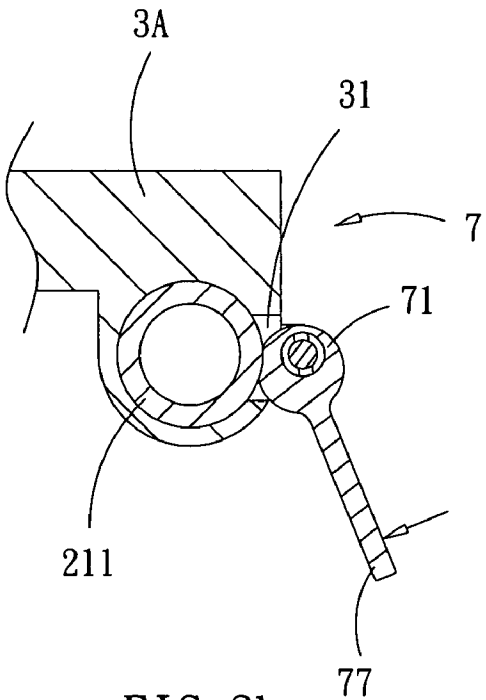
Figure 3C:
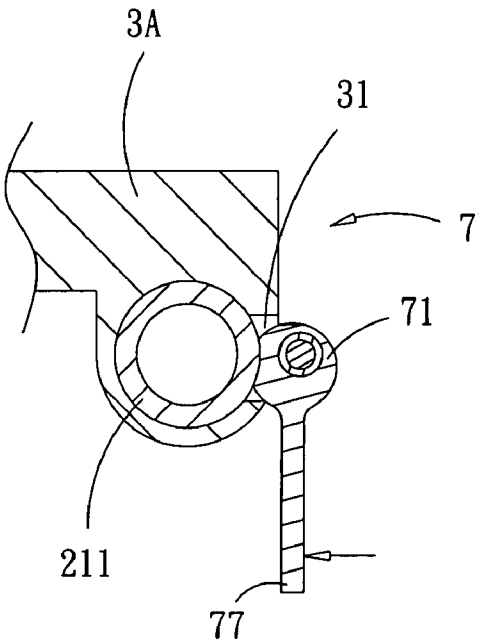

Referring to FIGS. 3A-3C, for fixing a position of the seat 4, the arm 77 is manually shifted, turning the blocking piece 71 and causing said blocking piece 71 to pass through said opening, so that the blocking piece 71 presses against one of the horizontal rods 211, 221, as shown in FIG. 1. Due to friction, the seat 4 will not glide along the horizontal rods 211, 221.

Thereby, the fixing device 7, mounted at the gliding block 3A, allows to fix the seat 4 in any desired position. For maximum convenience of using the bathing chair, the fixing device and the opening 31 are preferably placed at a front right corner or a rear right corner of the seat 4.

Figure 4:
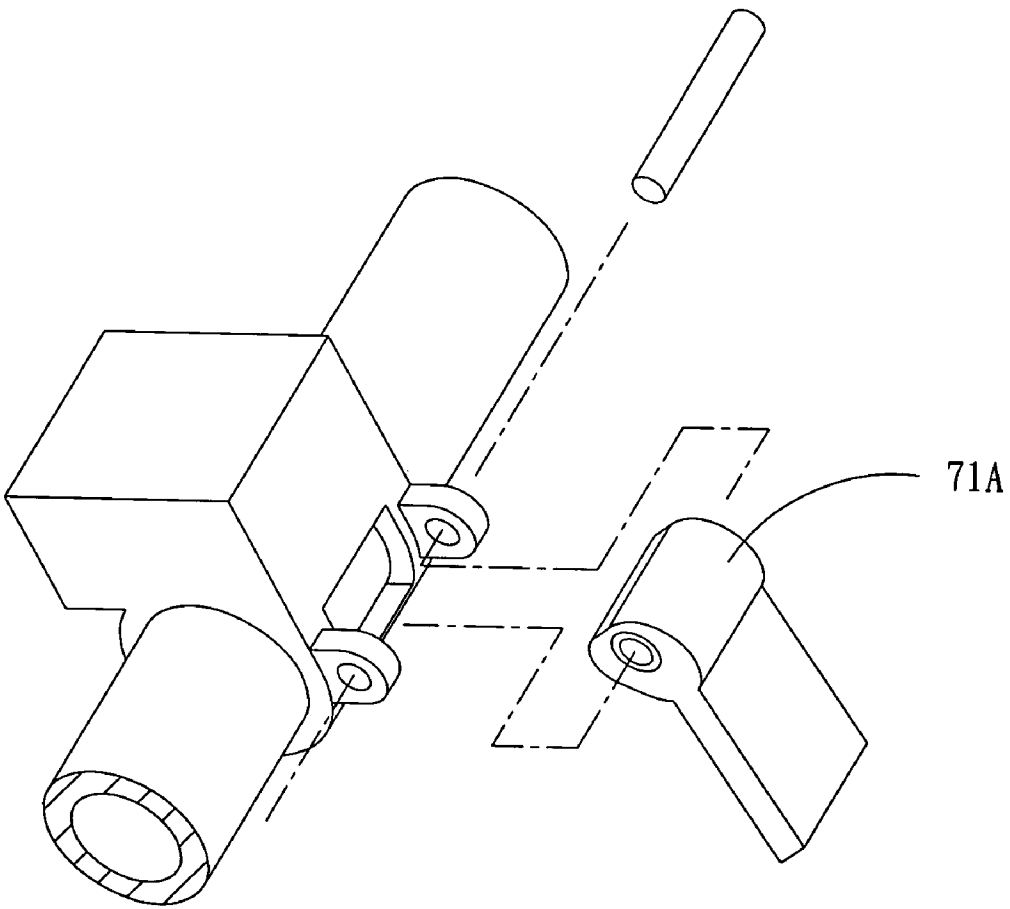
FIG. 4 is a perspective view of the fixing device mounted on a gliding block of the present invention in the second embodiment.

Referring to FIG. 4, in a second embodiment of the present invention, the blocking piece 71 is a cam.

While preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

The invention claimed is:

1. A bathing chair with a fixing device, comprising:

a front frame and a rear frame, shaped like the inverted letter U, reaching across a bathtub and having horizontal rods which pass over an edge of said bathtub at a distance, said front and rear frames being connected by right and left connecting rods;

a seat, which is a plate of roughly rectangular shape and is mounted on said horizontal rods;

a bearing assembly, further comprising several gliding blocks which are connected with said seat on a lower side thereof, keeping a distance thereto, and glide along said horizontal rods, with an opening cut into at least one of said gliding blocks;

a backrest, connected to said seat by two L-shaped link rods with horizontal extensions which are fastened to said gliding blocks of said bearing assembly, enabling said seat to glide along said horizontal rods;

a handle, which is a rod shaped like the inverted letter U and fastened to said front and rear frame rods at left ends thereof, reaching higher than said seat; and a fixing device, further comprising two lugs, each having a hole and aligned on two sides of said gliding block, a blocking piece, made of elastic material, having an excentric hole, and placed between said two lugs, an axis, passing through said holes of said two lugs and said excentric hole of said blocking piece, and an arm, attached to a periphery of said blocking piece;

wherein, for fixing a position of said seat, said arm is shifted, turning said blocking piece and causing said blocking piece to pass through said opening and to press against one of said horizontal rods, so that said seat is by friction prevented from moving.

2. The bathing chair with a fixing device of claim 1, wherein said opening is placed at a front, rear or lower edge of said bearing assembly.

3. The bathing chair with a fixing device of claim 1, wherein said blocking piece is a cam.

4. The bathing chair with a fixing device of claim 1, wherein a sleeve covers an inner wall of said excentric hole of said blocking piece, surrounding said axis.

5. The bathing chair with a fixing device of claim 1, wherein said sleeve is made of hard material.

* * * * *